US010520170B2

(12) United States Patent
DeBruin et al.

(10) Patent No.: US 10,520,170 B2
(45) Date of Patent: Dec. 31, 2019

(54) BRACKETS FOR LIGHTING FIXTURE SYSTEMS

(71) Applicant: Pinnacle Architectural Lighting Inc., Denver, CO (US)

(72) Inventors: Aaron DeBruin, Lakewood, CO (US); Arthur Evans, Denver, CO (US); Robert Parker, Aurora, CO (US)

(73) Assignee: PINNACLE ARCHITECTURAL LIGHTING INC., Denver, CO (US)

( * ) Notice: Subject to any disclaimer, the term of this patent is extended or adjusted under 35 U.S.C. 154(b) by 311 days.

(21) Appl. No.: 15/666,031

(22) Filed: Aug. 1, 2017

(65) Prior Publication Data

US 2019/0041041 A1 Feb. 7, 2019

(51) Int. Cl.

| | |
|---|---|
| ***F21S 8/00*** | (2006.01) |
| ***F21V 21/002*** | (2006.01) |
| ***F21V 21/02*** | (2006.01) |
| *A47F 7/00* | (2006.01) |
| *F21V 21/00* | (2006.01) |

(52) U.S. Cl.

CPC ..... *F21V 21/02* (2013.01); *F21S 8/038* (2013.01); *F21V 21/002* (2013.01); *A47F 7/00* (2013.01); *F21V 21/00* (2013.01)

(58) Field of Classification Search

CPC ..... F21S 8/038; F21S 8/066; F21V 21/002; F21V 21/025; F21V 21/005; F21V 19/0055; F21V 23/06

USPC ..... 248/535, 222.14, 292.12

See application file for complete search history.

(56) References Cited

U.S. PATENT DOCUMENTS

| | | | | |
|---|---|---|---|---|
| 4,717,993 | A | 1/1988 | Bernhart et al. | |
| 5,624,202 | A | 4/1997 | Grierson | |
| 5,658,066 | A | 8/1997 | Hirsch | |
| 2013/0279180 | A1* | 10/2013 | Pearson | F21V 21/008 362/371 |
| 2015/0177439 | A1* | 6/2015 | Durkee | G02B 6/0021 362/555 |
| 2015/0189991 | A1* | 7/2015 | Yang | A47B 97/00 248/292.12 |
| 2017/0328546 | A1* | 11/2017 | Gorman | F21V 21/005 |
| 2018/0112842 | A1* | 4/2018 | Butler | F21S 8/063 |
| 2018/0292055 | A1* | 10/2018 | Moioli | F21S 2/00 |

* cited by examiner

*Primary Examiner* — Alexander K Garlen
*Assistant Examiner* — Eric T Eide

(57) ABSTRACT

A bracket for joining a first fixture to a second fixture includes a housing configured to be coupled to the first fixture, a drive system disposed at least partially within the housing, and a retention member coupled to the drive system. The retention member is configured to engage with the second fixture and draw the second fixture and the first fixture together upon actuation of the drive system.

18 Claims, 9 Drawing Sheets

BRACKETS FOR LIGHTING FIXTURE SYSTEMS

INTRODUCTION

Elongated linear lighting fixtures may be used in internal and/or external spaces, such as retail, commercial, and office establishments, to illuminate the work space. These fixtures may be suspended, recessed, or surface mounted. With suspended fixtures, light may radiate upwardly against the ceiling or downwardly toward the floor to illuminate the work space. Typically these linear lighting fixtures are modular, with the segments assembled and connected on-site to form a long continuous lighting run. As such, interior designers, architects, and building owners often desire that the lighting fixtures are in strict alignment with no visible mounting hardware. Additionally, the lighting fixtures may be installed to heights of ten feet or more.

LIGHTING FIXTURE COUPLING BRACKET

This disclosure describes lighting fixture coupling brackets for use with linear lighting fixtures. More specifically, the brackets include a drive system that enables two lighting fixtures to be drawn together in a single operation for a tightly joined connection. Additionally, a link system enables the two lighting fixtures to be adjusted for linearity after being joined together. The drive system is accessible from the top and bottom of the lighting fixtures so that the bracket system may be used with suspended, recessed, or surface mounted systems.

In one aspect, the technology relates to a bracket for joining a first fixture to a second fixture, the bracket including: a housing configured to be coupled to the first fixture; a drive system disposed at least partially within the housing; and a retention member coupled to the drive system, wherein the retention member is configured to engage with the second fixture and draw the second fixture and the first fixture together upon actuation of the drive system.

In an example, the drive system includes a worm drive. In another example, the worm drive includes: a worm rotatable about a first rotating axis; and a worm gear rotatable about a second rotating axis, wherein the first rotating axis is orthogonal to the second rotating axis. In yet another example, the first fixture and the second fixture are drawn together along a longitudinal axis, and wherein the second rotating axis is parallel to the longitudinal axis. In still another example, the retention member includes a threaded bolt, wherein the threaded bolt is coupled to the worm gear and rotatable about the second rotating axis. In an example, the threaded bolt is coupled to the worm gear via a screw, and wherein the screw is configured to deform threads on the threaded bolt upon a predetermined torque value. In another example, the bracket further includes a link system, wherein the link system is configured to secure the first fixture to the second fixture and is coupled to the housing about a pivot point. In yet another example, the housing includes a first sidewall and an opposite second sidewall, and wherein the link system is disposed adjacent the first sidewall and the retention member is disposed adjacent the second sidewall.

In another aspect, the technology relates to a system including: a first lighting fixture having a first end; a second lighting fixture having a second end and a threaded nut disposed at the second end; and a bracket including: a housing configured to be received and secured within the first end; a worm drive including a worm rotatable about a first rotating axis and a worm gear rotatable about a second rotating axis; and a threaded bolt coupled to the worm gear, wherein the worm drive is configured to rotate the threaded bolt about the second rotating axis so as to engage the threaded nut and draw the second end and the first end together when actuated.

In an example, the worm includes a first end and an opposite second end, and wherein the worm is actuatable from the first end and the second end. In another example, the system further includes a link system coupled to the housing about a pivot point, wherein the link system extends from the first end to the second end. In yet another example, the first lighting fixture and the second lighting fixture extend along a longitudinal axis, and wherein the link system is offset a first direction from the longitudinal axis and the threaded bolt is offset a second and opposite direction from the longitudinal axis. In still another example, the system further includes at least one side bracket configured to extend between the first end and the second end. In an example, the housing includes a top surface, and wherein the bracket further includes a cable gripper extending from the top surface. In another example, the bracket further includes a pin connector. In yet another example, the first lighting fixture and the second lighting fixture are configured to substantially surround the bracket. In still another example, the system further includes a clutch assembly configured to couple to the second end of the second lighting fixture and receive the threaded bolt.

In another aspect, the technology relates to a method of assembling a lighting fixture system, the method including: coupling a bracket to a first end of a first lighting fixture, wherein the bracket includes a worm drive and a threaded bolt coupled to the worm drive; positioning a second end of a second lighting fixture adjacent to the threaded bolt, wherein the second end includes a threaded nut; and actuating the worm drive such that the threaded bolt engages the threaded nut and draws the second end toward the first end. In an example, the method further includes attaching a link system to the first end and the second end and to the bracket at a pivot point. In another example, the pivot point defines a pivot axis, the method further includes aligning the first lighting fixture with the second lighting fixture by actuating the worm drive such that the second end pivots relative to the first end about the pivot axis.

These and various other features as well as advantages which characterize the lighting fixture coupling brackets and methods described herein will be apparent from a reading of the following detailed description and a review of the associated drawings. Additional features are set forth in the description which follows, and in part will be apparent from the description, or may be learned by practice of the technology. The benefits and features of the technology will be realized and attained by the structure particularly pointed out in the written description and claims hereof as well as the appended drawings.

It is to be understood that both the foregoing introduction and the following detailed description are exemplary and explanatory and are intended to provide further explanation of the invention as claimed.

BRIEF DESCRIPTION OF THE DRAWINGS

The following drawing figures, which form a part of this application, are illustrative of described technology and are not meant to limit the scope of the invention as claimed in any manner, which scope shall be based on the claims appended hereto.

DETAILED DESCRIPTION

Before the lighting fixture coupling brackets and methods that are the subject of this disclosure are described, it is to be understood that this disclosure is not limited to the particular structures, process steps, or materials disclosed herein, but is extended to equivalents thereof as would be recognized by those ordinarily skilled in the relevant arts. It should also be understood that terminology employed herein is used for the purpose of describing particular embodiments only and is not intended to be limiting. It must be noted that, as used in this specification, the singular forms "a," "an," and "the" include plural referents unless the context clearly dictates otherwise.

This disclosure describes lighting fixture coupling brackets for use in an assembly of a linear lighting fixture. The brackets enable two lighting fixtures to be joined tightly together and also to enable the lighting fixtures to be adjusted for linearity after being joined together, with no visible bracket hardware. Accordingly, the brackets described herein increase straightness and alignment of a run of two or more linear lighting fixtures for enhanced aesthetic and architectural appeal. Additionally, the complexity and time involved in securely joining a run of two or more linear lighting fixtures together is decreased. A drive system for drawing two lighting fixtures together and to align the lighting fixtures is accessible from the top and the bottom of the lighting fixtures.

Figure 1:
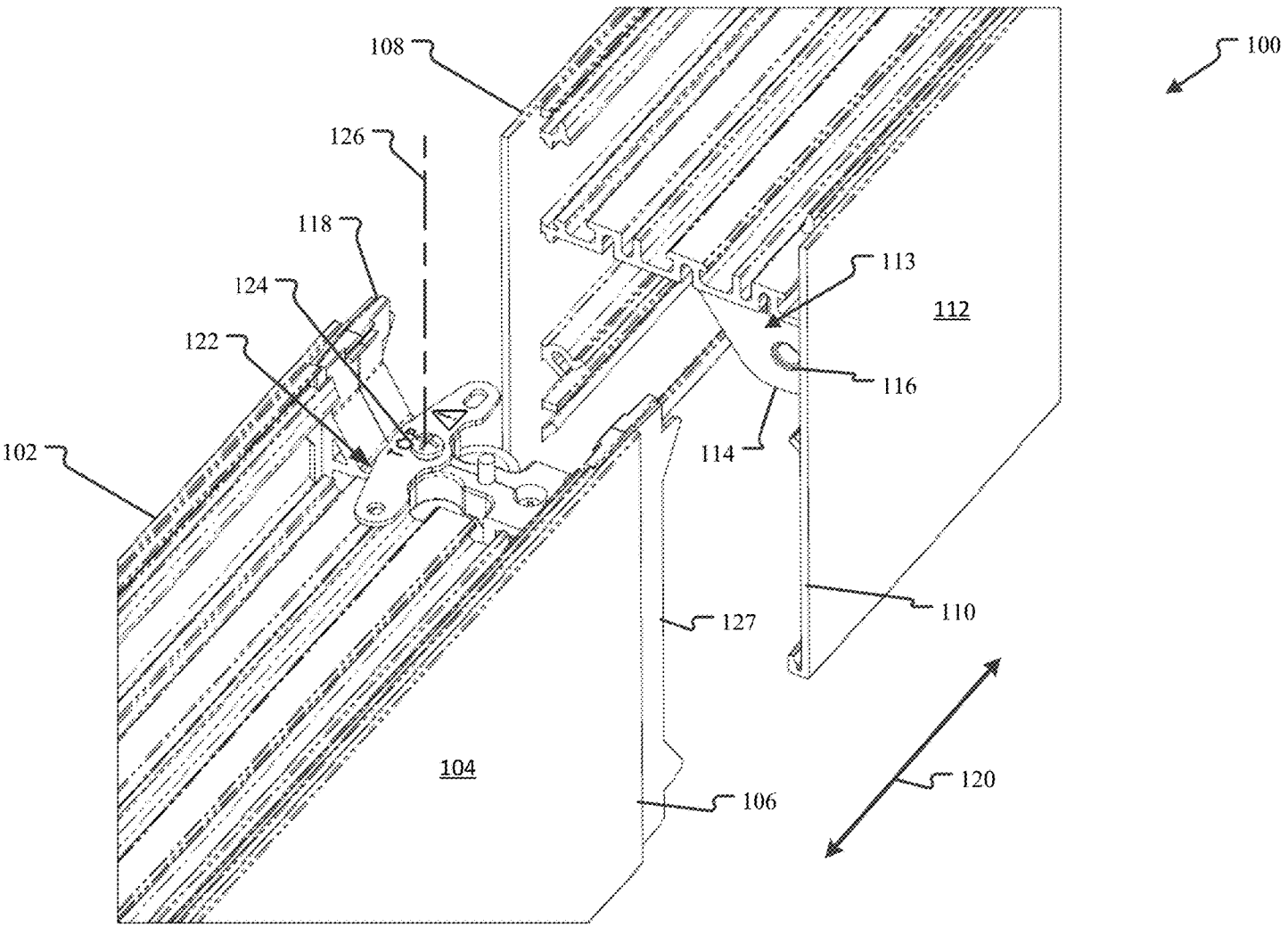
FIG. 1 is a partially exploded perspective view of an exemplary linear lighting system.

FIG. 1 is a partially exploded perspective view of an exemplary linear lighting system 100. The lighting system 100 includes an elongated first lighting fixture 102 having a housing 104 with a light source (not shown) disposed therein. The first lighting fixture 102 has a first free end 106 that may be coupled to an elongated second lighting fixture 108 having a second free end 110. The second lighting fixture 108 also has a housing 112 with a light source (not shown) disposed therein. The second end 110 includes a receiver 113 that has a tab 114 positioned within the housing 112 with a threaded nut 116. In some examples, the receiver 113 is unitary with the housing 112, while in other examples, the receiver 113 may be installed onto the housing 112.

The lighting system 100 also includes a bracket 118 that connects and secures the first end 106 of the first lighting fixture 102 to the second end 110 of the second lighting fixture 108 along a longitudinal axis 120. More specifically, a portion of the bracket 118 is inserted and secured within the first end 106 of the first lighting fixture 102. The second end 110 of the second lighting fixture 108 is then positioned adjacent to the bracket 118. For example, a retention member 156 (shown in FIG. 2) that extends from the bracket 118 along the longitudinal axis 120 is placed within the threaded nut 116. The retention member is then actuated so that it engages with the receiver 113. The bracket 118, via the retention member, draws the second end 110 and the first end 106 together so that a portion of the bracket 118 is also received within the second end 110, and that the first lighting fixture 102 is joined next to the second lighting fixture 108. Thus, the position of the bracket 118 proximate both the first end 106 and the second end 110 increase rigidity of the lighting system 100, decreases movement between adjacent lighting fixtures, and can be all that is needed to join adjacent lighting fixtures together.

Once the first end 106 is adjacent to the second end 110, a link system 122 may be coupled to the first lighting fixture 102, the second lighting fixture 108, and the bracket 118 along the longitudinal axis 120. By securing all three components through the link system 122, a pivot point 124 is formed between the first and second ends 106, 110 having a pivot axis 126 that extends through the bracket 118 so that the first lighting fixture 102 may pivot about the pivot axis 126 relative to the second lighting fixture 108. This enables the first lighting fixture 102 to be finely aligned along the longitudinal axis 120 with the second lighting fixture 108 by actuating the retention member again and drawing the second end 110 and the first end 106 either further towards or more away from each other so as to straighten and square off the connection joint and increase visual appeal. Moreover, because of the manufacturing tolerances of the lighting fixtures 102, 108, the ends 106, 110 may not be completely orthogonal and the effect of the tolerances can be multiplied along a long linear string of fixtures. As such, by enabling the lighting fixtures 102, 108 to be aligned after being pulled together, the effect of the manufacturing tolerances is reduced. In alternative examples, the lighting system 100 can include lighting fixtures 102, 108 positioned in any other configuration, such as, but not limited to, curved shapes, L-shapes, X-shapes, and/or T-shapes. For example, the bracket 118 can enable an end of one lighting fixture to couple to a mid-point of another lighting fixture forming a T-shape.

Additionally, the lighting system 100 can include a pair of side brackets 127 that are positioned between the bracket 118 and the housings 104, 112 at the connection joint. The side brackets 127 extend substantially the height of the entire housing ends 106, 110 from the bottom to the top. During assembly, the side brackets 127 are snap-fit within the first lighting fixture 102 before the bracket 118 is secured to the first lighting fixture 102. As the first and second lighting fixtures 102, 108 are drawn together, via the bracket 118, the side brackets 127 also snap-fit within the second lighting fixture 108 so that the side brackets 127 extend between and overlap with the first and second ends 106, 110. The side brackets 127 enable the first and second lighting fixtures 102, 108 to be aligned without gaps forming at the connection joint between the first and second ends 106, 110. By covering any gaps that may form at the connection joint, dirt and dust accumulation within the lighting fixtures 102, 108 is reduced and light is prevented from shining through the connection joint.

Figure 2:
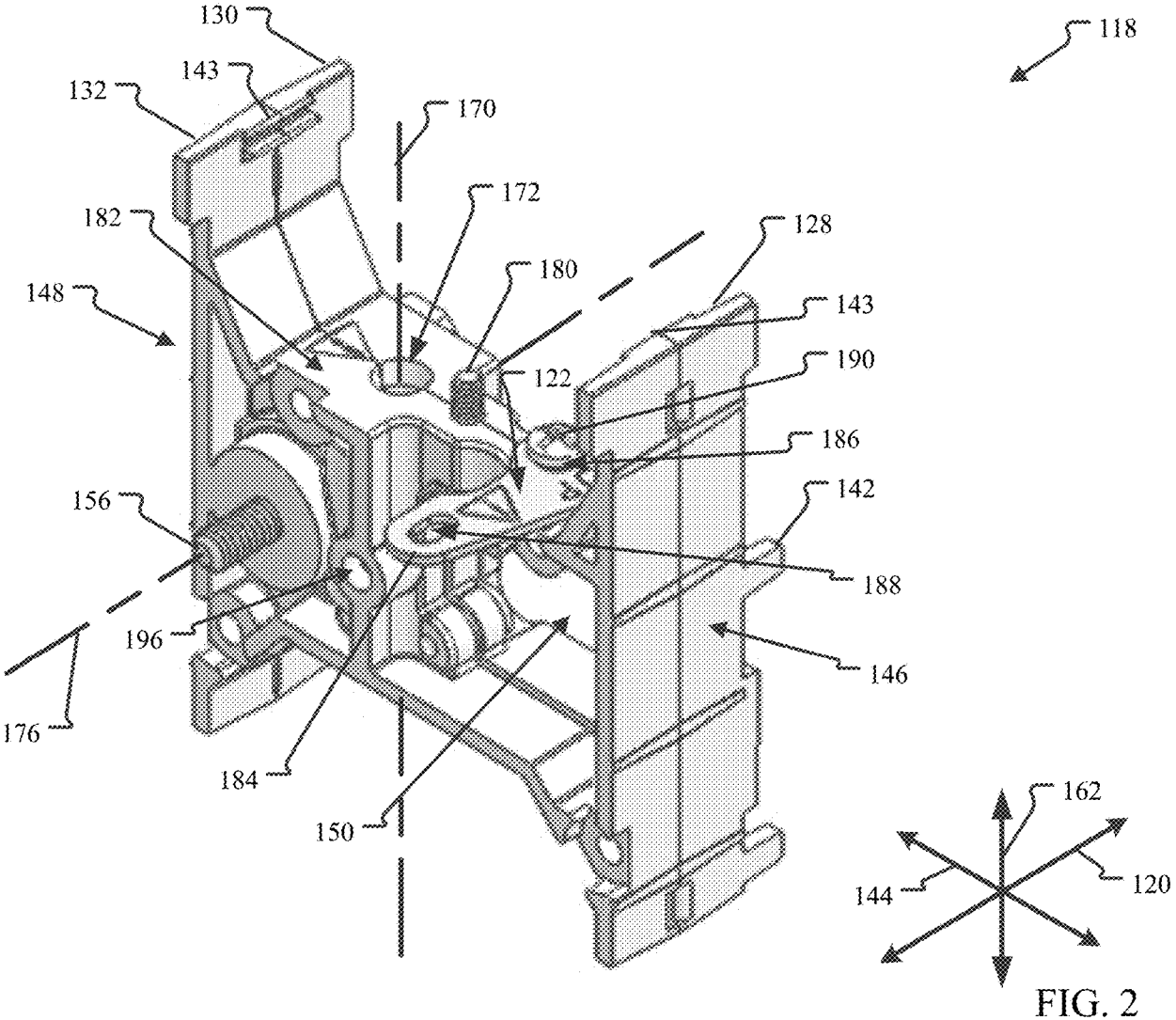
FIG. 2 is a perspective view of an exemplary bracket that may be used in the linear lighting system shown in FIG. 1.
Figure 3:
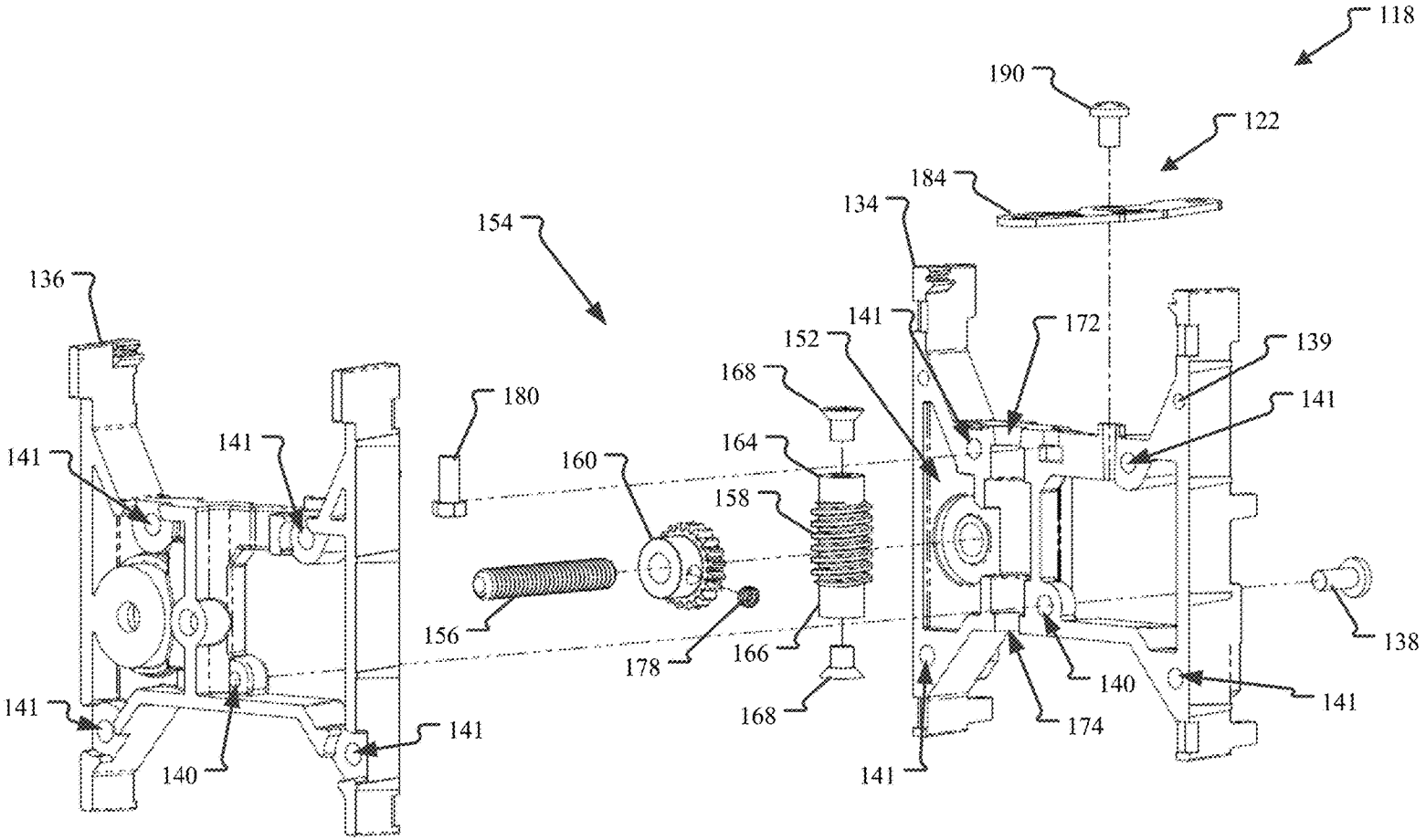
FIG. 3 is an exploded perspective view of the bracket shown in FIG. 2.

FIG. 2 is a perspective view of the bracket 118 that may be used in the linear lighting system 100 (shown in FIG. 1). FIG. 3 is an exploded perspective view of the bracket 118. Referring concurrently to FIGS. 2 and 3, and with continued reference to FIG. 1, the bracket 118 includes an asymmetrical housing 128 extending along the longitudinal axis 120 and having a first end 130 and an opposite second end 132. The housing 128 may be formed of a first member 134 and a second member 136 that are coupled together. For example, the first and second members 134, 136 may be coupled together via one or more screws 138 inserted within one or more corresponding apertures 140 defined within the housing 128. In alternative examples, the first and second members 134, 136 may have corresponding cast features 139 that snap-fit together or any other connection type (e.g., adhesive, brazing, welding, etc.) that enables the bracket 118 to function as described herein.

A plurality of through-holes 141 are defined within the housing 128 that are sized and shaped to receive fasteners 192 (shown in FIG. 6) so as to secure the bracket 118 within the housing 104 of the first lighting fixture 102. In alternative examples, a plurality of projections 142 extend longitudinally from the first end 130 of the housing 128 that are configured to be received within the housing 104 of the first lighting fixture 102 so that the first end 130 of the bracket 118 may be secured to the first lighting fixture 102. The housing 128 may also include a pair of connector elements 143 disposed at the top of the housing 128 that are configured to receive a cover plate (not shown).

The housing 128 is also asymmetrical about a transverse axis 144 that extends between two opposing sidewalls 146, 148 of the housing 128. Proximate the first sidewall 146, an electrical connector passageway 150 is defined in the housing 128. The passageway 150 enables wires (not shown) to be extended through the bracket 118 so that the adjacent lighting fixtures may be electrically and/or communicatively coupled together. Proximate the second sidewall 148, the housing 128 defines an interior cavity 152 formed by the first and seconds members 134, 136. A drive system 154 and a retention member 156 are at least partially disposed within the interior cavity 152. In the example, the drive system 154 is a worm drive that includes a rotatable worm 158 that meshes with a rotatable worm gear 160 which is coupled to the retention member 156. In operation, actuating the worm 158 induces rotation of the retention member 156 so as to draw the second lighting fixture 108 and the first lighting fixture 102 together as described above. In alternative examples, the drive system 154 may be any other system that enables the bracket 118 to function as described herein, such as the retention member 156 being driven directly along its axis of rotation.

The worm 158 extends along a vertical axis 162 and has a first end 164 and an opposite second end 166. Each end 164, 166 includes a bolt 168 such that the worm 158 may be actuated by a screwdriver, for example, so that the worm 158 rotates about a first rotating axis 170 that is parallel to the vertical axis 162. The housing 128 has two actuating openings 172, 174, at the top and bottom of the housing 128, respectively, so that the worm 158 may be actuated from either the top or bottom upon installation. The worm 158 is meshed with the worm gear 160 so that rotation of the worm 158 induces rotation of the worm gear 160 about a second rotating axis 176 which is parallel to the longitudinal axis 120 and orthogonal to the first rotating axis 170.

The worm gear 160 is fixed to the retention member 156 via a screw 178 so that rotation of the worm gear 160 induces corresponding rotation of the retention member 156 about the second rotating axis 176. In the example, the screw 178 may be configured to deform the threads of the retention member 156 upon a predetermined torque value such that the drive system 154 cannot be overtightened, and wear on the lighting fixtures is reduced. Upon deformation of the threads, further rotation of the worm gear 160 no longer induces corresponding rotation of the retention member 156; instead, the worm gear 160 is freely rotatable about the retention member 156. In other examples, the screw 178 may be configured to fuse (e.g., deform or break) upon a predetermined torque value such that the worm gear 160 is freely rotatable about the retention member 156 and the drive system 154 cannot be overtightened. In yet other examples, the worm 158 and/or worm gear 160 racks may be configured to fuse thereby reducing the problems associated with overtightening. In further examples, the worm 158 may be coupled to the bolts 168 by a screw (not shown) that is configured to fuse upon a predetermined torque valve. The retention member 156 may be a threaded draw bolt that extends out of the second end 132 of the housing 128. The threaded bolt corresponds to receiver 113 and the threaded nut 116 of the second lighting fixture 108 such that upon rotation of the threaded bolt, the threads engage and pull the second lighting fixture 108 towards the bracket 118.

Additionally, the bracket 118 may include a cable gripper 180 extending from a top surface 182 so that the bracket 118 may be coupled to the support cable 194 (shown in FIG. 6) in a suspended lighting system. Also, connecting to the top surface 182 is the link system 122. The link system 122 includes a plate 184 with a center hole 186 and two opposing end holes 188. Each end hole 188 may receive a screw (not shown) for coupling the plate 184 to each lighting fixture 102, 108. The center hole 186 may also receive a screw 190 for coupling the plate 184 to the housing 128. In an example, the screw 190 may be thread cutting so as to secure to the housing 128. The center hole 186 also defines the pivot point 124 and pivot axis 126 as described above. In the example, the plate 184 is substantially flat. In alternative examples, the plate 184 may have one or both ends disposed at an angle relative to the middle section to facilitate more space for attaching the lighting fixture housings.

In the example, the worm gear 160 and the attached retention member 156, and the worm 158 and the attached bolts 168 are assembled into the housing 128, so that the worm 158 and the worm gear 160 are in mesh and so that the retention member 156 is extending out of the second end 132 of the housing 128. The worm 158 and the bolts 168 are oriented vertically along the vertical axis 162 in the housing 128, while the worm gear 160 and the retention member 156 are oriented horizontally along the longitudinal axis 120 in the housing 128. The bracket 118 may then be installed and secured into the first end 106 of the first lighting fixture 102.

The receiver 113 may be installed into an adjoining fixture 108 so that the axis of the receiver 113 is collinear with the retention member 156. This configuration enables a rotational motion to be applied to the worm 158 along the vertical axis 162, either from the top or the bottom of the bracket 118, and in a direction away from the lighting fixture housings 104, 112. The rotational motion of the worm 158 induces the retention member 156 to rotate and the aligned retention member 156 and receiver 113 engage to pull the lighting fixtures 102, 108 together until the first end 106 is in contact with the second end 110. Once the ends are in contact, the link system 122 may be installed across the lighting fixtures 102, 108 and the bracket 118. The link system 122 is installed on the opposite side of the bracket 118 than the retention member 156. As such, the link system 122 serves as the pivot point 124 to enable the retention member 156, through the action of the worm 158, to pull the lighting fixtures 102, 108 together or push the lighting fixtures 102, 108 apart and facilitate linear alignment along the longitudinal axis 120. In some examples, the second end 132 of the housing 128 includes a recess 196 that is configured to receive a corresponding projection (not shown) from the clutch assembly 500 (shown in FIG. 9) so that the clutch assembly aligns with the housing 128 when the two are drawn together.

Figure 4:
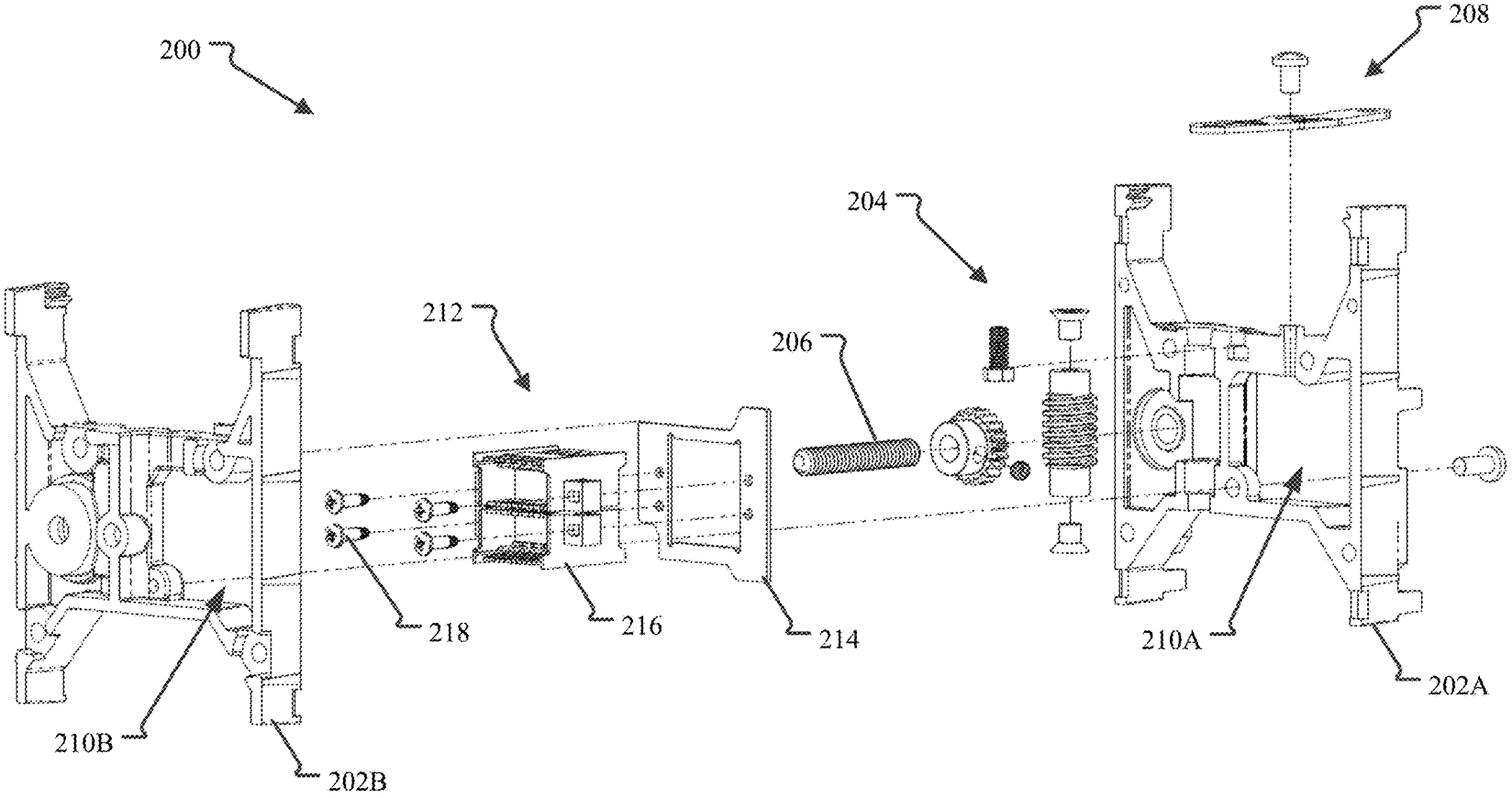
FIG. 4 is an exploded perspective view of another exemplary bracket that may be used in the linear lighting system shown in FIG. 1.

FIG. 4 is an exploded perspective view of another exemplary bracket 200 that may be used in the linear lighting system 100 (shown in FIG. 1). Similar to the above described bracket, this bracket 200 includes a modular housing 202 that houses a drive system 204 and a retention member 206, a link system 208, and an electrical connector passageway 210. However, in this example, the bracket 200 also includes a pin connector 212 so that the bracket 200 facilitates electrically and/or communicatively coupling the adjoining lighting fixtures together. More specifically, the pin connector 212 includes a keeper 214 sized and shaped to correspond to the passageway 210. A connector block 216 may be coupled to the keeper 214 via a plurality of screws 218. The connector block 216 enables receipt of electrical and/or communication wiring (not shown) such that two or more wires may be strung together in series with the bracket 200 serving as the junction point. For example, the connector block 216 can be a pair of six-pole panel feedthrough male connectors with fixing flanges that are mounted within the passageway 210 via mounting flanges. These connectors may be rated for current and/or voltages as required or desired.

As described above, the bracket 200 connects and secures two lighting fixtures together. For example, a portion of the bracket 200 is inserted and secured within one fixture. Another fixture is positioned adjacent to the bracket 200 so that when the retention member 206 is actuated by the drive system 204, the bracket 200 may draw the fixtures together. Once the fixtures are drawn together, the link system 208 is coupled to each fixture and the bracket 200. The drive system 204 may then be further actuated to finely align the two fixtures and remove any undesirable gaps in the connection joint.

Figure 5:
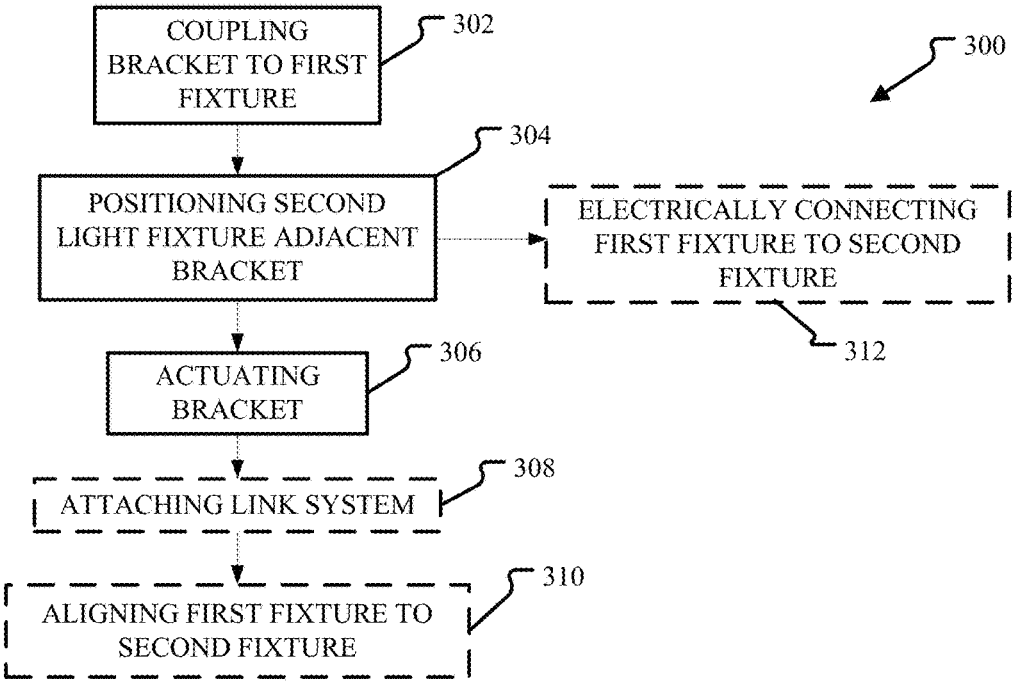
FIG. 5 is a flowchart illustrating a method of assembling a lighting fixture system.

FIG. 5 is a flowchart illustrating a method 300 of assembling a lighting fixture system. The method 300 includes coupling a bracket to a first end of a first lighting fixture, wherein the bracket includes a worm drive and a threaded bolt coupled to the worm drive (operation 302), positioning a second end of a second lighting fixture adjacent to the threaded bolt, wherein the second end includes a threaded nut (operation 304), and actuating the worm drive such that the threaded bolt engages the threaded nut and draws the second end toward the first end (operation 306). In some examples, the method 300 further includes attaching a link system to the first end and the second end and to the bracket at a pivot point (operation 308). In other examples, the pivot point defines a pivot axis and the method further includes aligning the first lighting fixture with the second lighting fixture by actuating the worm drive such that the second end pivots relative to the first end about the pivot axis (operation 310). In another example, the method 300 also includes electrically connecting the first lighting fixture to the second lighting fixture (operation 312). The electrical connection may occur after the positioning second lighting fixture and before actuating the worm drive or may automatically occur during the actuation of the worm drive.

Figure 6:
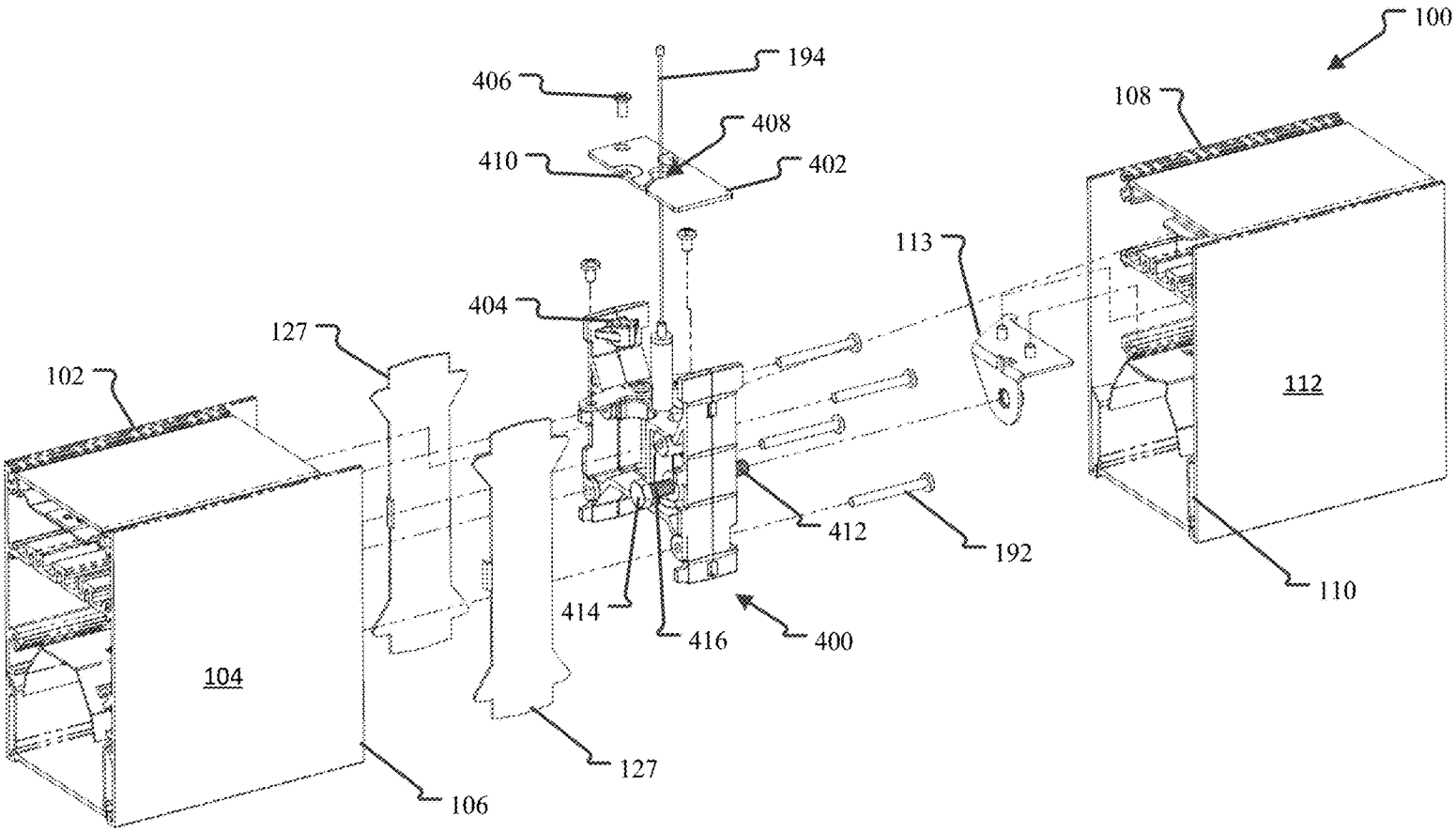
FIG. 6 is an exploded perspective view of another exemplary bracket that may be used in the linear lighting system shown in FIG. 1.
Figure 7:
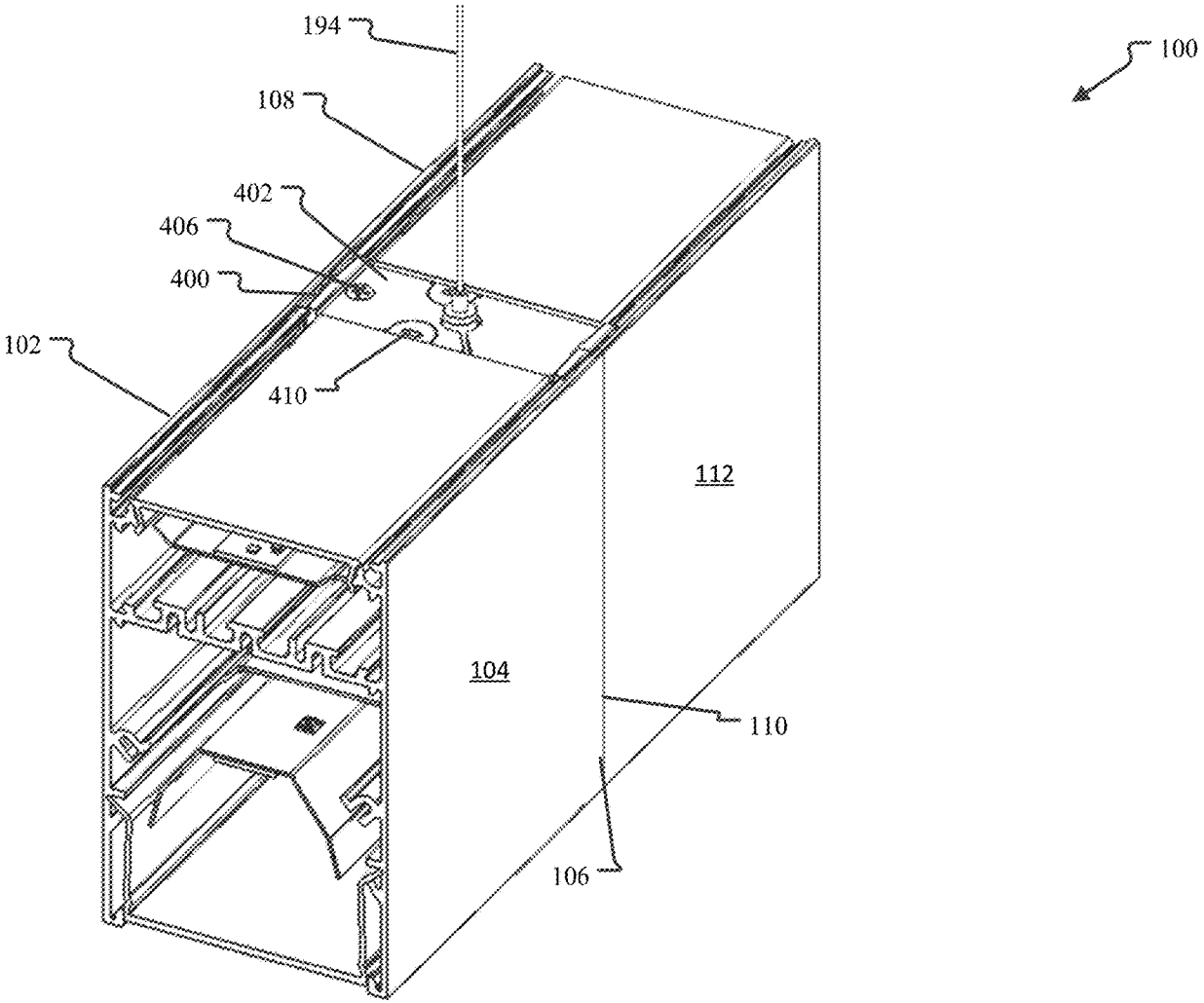
FIG. 7 is a perspective view of the bracket shown in FIG. 6 assembled within the linear lighting system.

FIG. 6 is an exploded perspective view of another exemplary bracket 400 that may be used in the linear lighting system 100. FIG. 7 is a perspective with of the bracket 400 assembled within the linear lighting system 100. Referring concurrently to FIGS. 6 and 7, the bracket 400 connects and secures the first end 106 of the first lighting fixture 102 to the second end 110 of the second lighting fixture 108 as described above. The bracket 400 is secured to the first lighting fixture 102 by a plurality of fasteners 192 that extend through the bracket 400 and engage with the housing 104. Additionally, the lighting system 100 includes a pair of side brackets 127, and includes the receiver 113 that attaches to the second lighting fixture 108. However, in this example, the bracket 400 includes a cover plate 402 that couples to the top of the bracket 400 so as to restrict dirt and dust from accumulating within the lighting fixtures 102, 108 and to prevent light from shining through the top of the connection joint. The bracket 400 includes a connector element 404 that are sized and shaped to receive a fastener 406 so that the cover plate 402 may be secured to the bracket 400. In alternative examples, the connector element 404 may be a snap fit connection.

As illustrated, the bracket 400 may be supported by a support cable 194 that is coupled to the top of the bracket 400. The cover plate 402 can include a channel 408 defined therein so that the cover plate 402 can fit around the support cable 194. The cover plate 402 can also include one or more tabs 410 that are configured to break out and form an opening so that data cables (e.g., cables that run along the support cable 194, not shown) can be channeled through the cover plate 402. Additionally, in this example, the bracket 400 includes a retention member 412 that has a head portion 414 and a threaded portion 416. The head portion 414 restricts the retention member 412 from being pulled all the way through the bracket 118 along the rotating axis.

Figure 8:
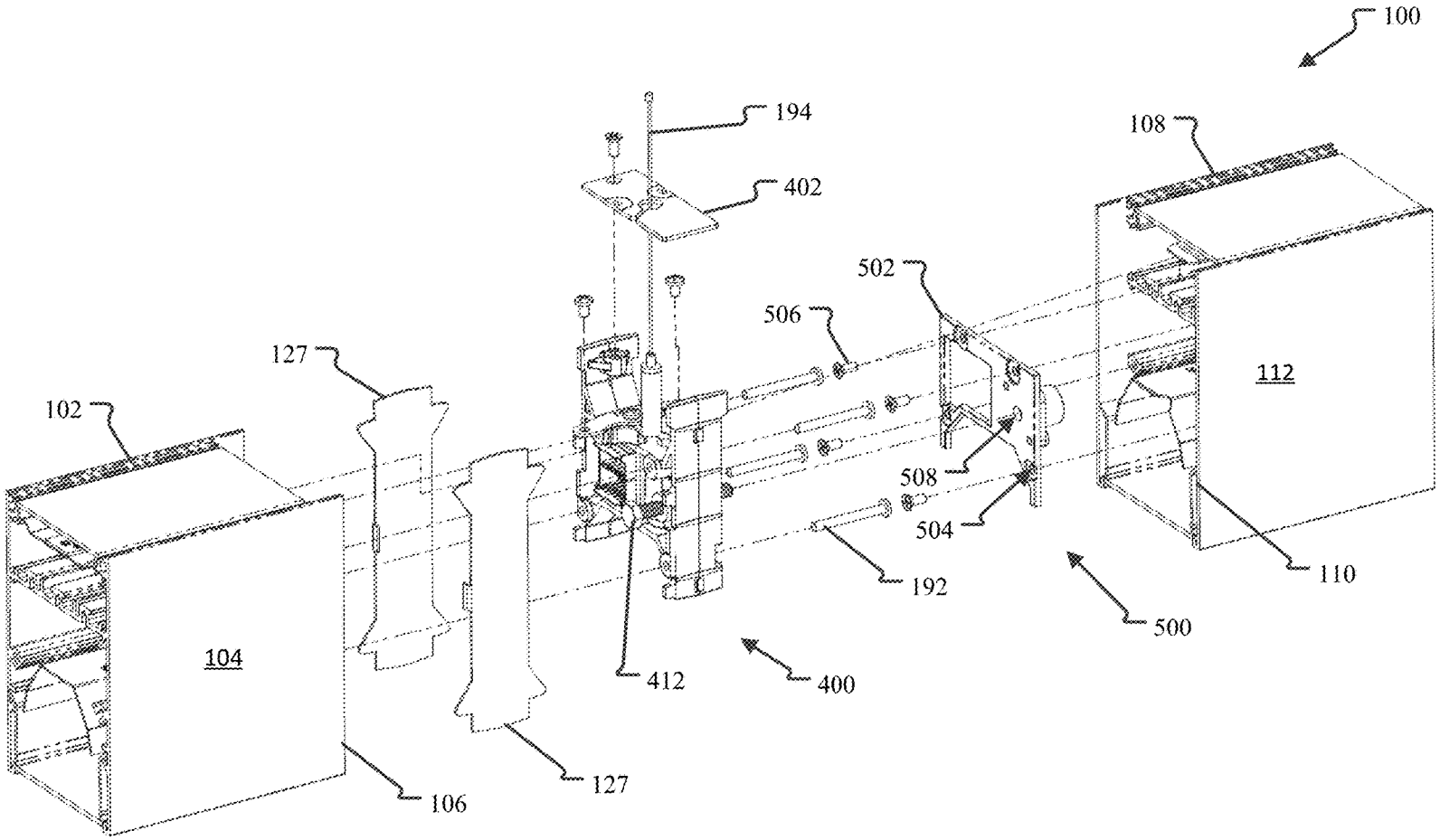
FIG. 8 is an exploded perspective view of the bracket shown in FIG. 6 including an exemplary clutch assembly.
Figure 9:
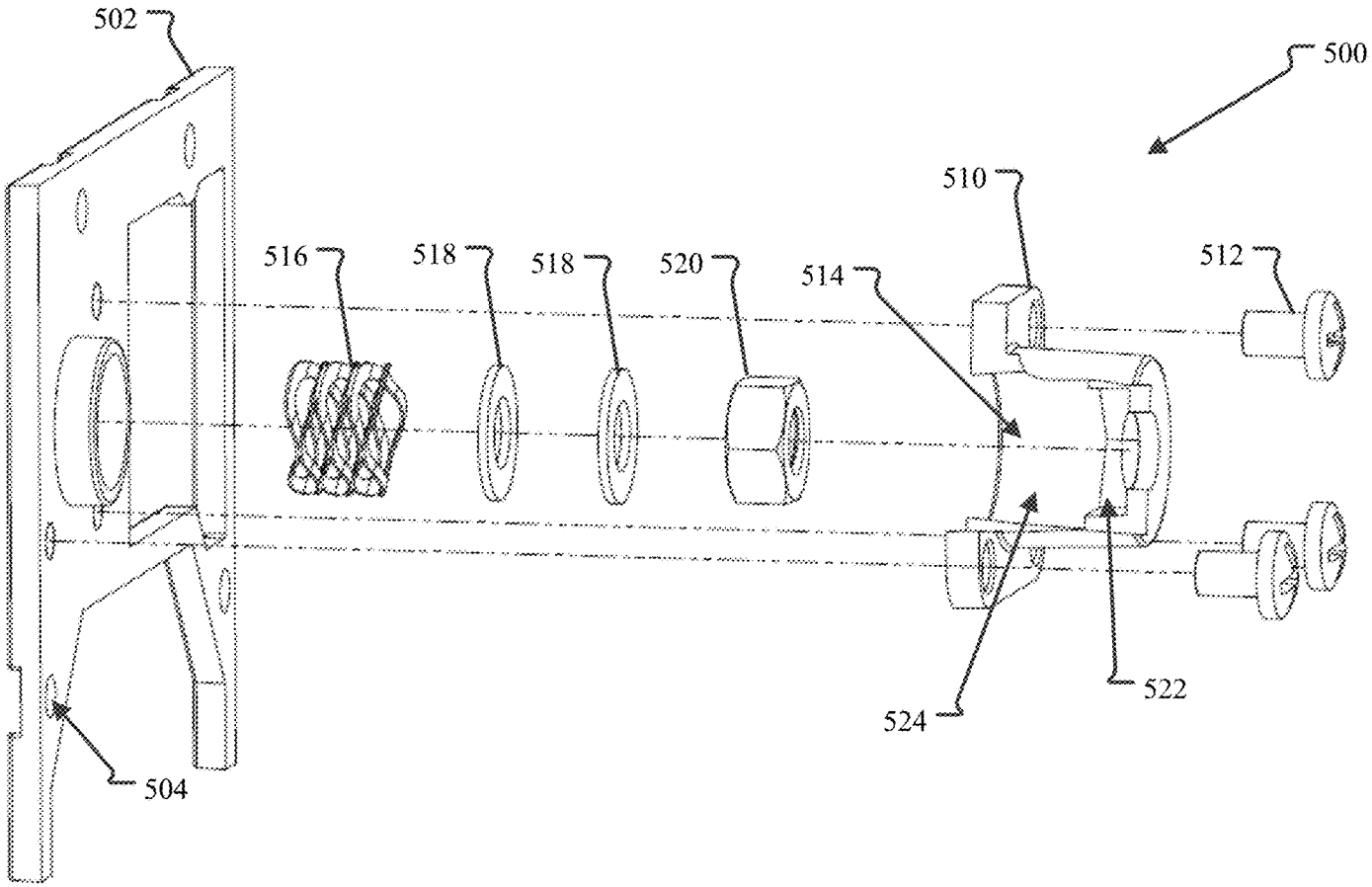
FIG. 9 is an exploded perspective view of the clutch assembly.

FIG. 8 is an exploded perspective view of the bracket 400 including an exemplary clutch assembly 500. FIG. 9 is an exploded perspective view of the clutch assembly 500. Referring concurrently to FIGS. 8 and 9, the bracket 400 connects and secures the first end 106 of the first lighting fixture 102 to the second end 110 of the second lighting fixture 108 as described above. However, in this example, the bracket 400 further includes the clutch assembly 500 that is configured to receive the retention member 412 and prevent the drive system from being overtightened.

The clutch assembly 500 includes a plate 502 similarly sized and shaped to the bracket 400. The plate 502 includes one or more through-holes 504 so that fasteners 506 can secure the clutch assembly 500 to the second lighting fixture 108 at the second end 110. A retention member opening 508 is also defined within the plate 502. On one side of the plate 502, a housing 510 is disposed around the retention member opening 508. The housing 510 may be secured to the plate 502 by one or more fasteners 512. The housing 510 defines a cavity 514 in which a wave spring 516, one or more washers 518, and a nut 520 are disposed.

In operation, the plate 502 is secured to the second lighting fixture 108 and the housing 510 receives the retention member 412 so as to draw the first and second lighting fixtures 102, 108 together. Within the housing 510, the retention member 412 engages, via threads, with the nut 520 that is positioned within a first portion 522 of the cavity 514. The first portion 522 is formed by an interior surface that corresponds to the shape of the nut 520 so that upon rotation of the retention member 412, rotation of the nut 520 is prevented and the plate 502 and bracket 400 can be drawn together. The nut 520 is positioned within the first portion 522 by the spring 516. However, to prevent overtightening of the drive system, upon a predetermined compression value, the spring 516 compresses such that the nut 520 slides out of the first portion 522 of the housing an into a second portion 524 of the housing. The second portion 524 is formed by an interior surface that is cylindrical and that does not engage with the nut 520. As such, upon further rotation of the retention member 412, the nut 520 also rotates within the second portion, and the plate 502 and the bracket 400 are prevented from being further drawn together. The washers 518 are included to reduce friction between the spring 516 and the nut 520.

It will be clear that the systems and methods described herein are well adapted to attain the ends and advantages mentioned as well as those inherent therein. Those skilled in the art will recognize that the methods and systems within this specification may be implemented in many manners and as such is not to be limited by the foregoing exemplified embodiments and examples. In this regard, any number of the features of the different embodiments described herein may be combined into one single embodiment and alternate embodiments having fewer than or more than all of the features herein described are possible. While various embodiments have been described for purposes of this disclosure, various changes and modifications may be made which are well within the scope contemplated by the present disclosure.

What is claimed is:

1. A bracket for coining a first fixture to a second fixture, the bracket comprising:

a housing configured to be coupled to the first fixture;

a drive system disposed at least partially within the housing, wherein the drive system comprises a worm drive comprising:

a worm rotatable about a first rotating axis; and a worm gear rotatable about a second rotating axis, wherein the first rotating axis is orthogonal to the second rotating axis; and a retention member coupled to the drive system, wherein the retention member is configured to engage with the second fixture and draw the second fixture and the first fixture together upon actuation of the drive system.

2. The bracket of claim 1, wherein the first fixture and the second fixture are drawn together along a longitudinal axis, and wherein the second rotating axis is parallel to the longitudinal axis.

3. The bracket of claim 1, wherein the retention member comprises a threaded bolt, and wherein the threaded bolt is coupled to the worm gear and rotatable about the second rotating axis.

4. The bracket of claim 3, wherein the threaded bolt is coupled to the worm gear via a screw, and wherein the screw is configured to deform threads on the threaded bolt upon a predetermined torque value.

5. The bracket of claim 1 further comprising a link system, wherein the link system is configured to secure the first fixture to the second fixture and is coupled to the housing about a pivot point.

6. The bracket of claim 5, wherein the housing comprises a first sidewall and an opposite second sidewall, and wherein the link system is disposed adjacent the first sidewall and the retention member is disposed adjacent the second sidewall.

7. A system comprising:

a first lighting fixture having a first end;

a second lighting fixture having a second end and a threaded nut disposed at the second end; and a bracket comprising:

a housing configured to be received and secured within the first end;

a worm drive comprising a worm rotatable about a first rotating axis and a worm gear rotatable about a second rotating axis; and a threaded bolt coupled to the worm gear, wherein the worm drive is configured to rotate the threaded bolt about the second rotating axis so as to engage the threaded nut and draw the second end and the first end together when actuated.

8. The system of claim 7, wherein the worm comprises a first end and an opposite second end, and wherein the worm is actuatable from the first end and the second end.

9. The system of claim 7 further comprising a link system coupled to the housing about a pivot point, wherein the link system extends from the first end to the second end.

10. The system of claim 9, wherein the first lighting fixture and the second lighting fixture extend along a longitudinal axis, and wherein the link system is offset a first direction from the longitudinal axis and the threaded bolt is offset a second and opposite direction from the longitudinal axis.

11. The system of claim 7 further comprising at least one side bracket configured to extend between the first end and the second end.

12. The system of claim 7, wherein the housing comprises a top surface, and wherein the bracket further comprises a cable gripper extending from the top surface.

13. The system of claim 7, wherein the bracket further comprises a pin connector.

14. The system of claim 7, wherein the first lighting fixture and the second lighting fixture are configured to substantially surround the bracket.

15. The system of claim 7 further comprising a clutch assembly configured to couple to the second end of the second lighting fixture and receive the threaded bolt.

16. A method of assembling a lighting fixture system, the method comprising:

coupling a bracket to a first end of a first lighting fixture, wherein the bracket includes a worm drive and a threaded bolt coupled to the worm drive;

positioning a second end of a second lighting fixture adjacent to the threaded bolt, wherein the second end includes a threaded nut; and actuating the worm drive such that the threaded bolt engages the threaded nut and draws the second end toward the first end, wherein the worm drive include a worm rotatable about a first rotatable axis and a worm gear rotatable about a second rotating axis, and wherein the first rotating axis is orthogonal to the second rotating axis.

17. The method of claim 16 further comprising attaching a link system to the first end and the second end and to the bracket at a pivot point.

18. The method of claim 17, wherein the pivot point defines a pivot axis, the method further comprising aligning the first lighting fixture with the second lighting fixture by actuating the worm drive such that the second end pivots relative to the first end about the pivot axis.

* * * * *